US011031700B2

(12) United States Patent
Ariumi

(10) Patent No.: US 11,031,700 B2
(45) Date of Patent: Jun. 8, 2021

(54) ANTENNA MODULE AND COMMUNICATION DEVICE

(71) Applicant: Murata Manufacturing Co., Ltd., Kyoto (JP)

(72) Inventor: Saneaki Ariumi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/592,989

(22) Filed: Oct. 4, 2019

(65) Prior Publication Data

US 2020/0036103 A1 Jan. 30, 2020

Related U.S. Application Data

(63) Continuation of application No. PCT/JP2018/012228, filed on Mar. 26, 2018.

(30) Foreign Application Priority Data

Apr. 7, 2017 (JP) ..... JP2017-076732

(51) Int. Cl.
*H01Q 21/06* (2006.01)
*H01Q 21/00* (2006.01)
(Continued)

(52) U.S. Cl.
CPC ..... *H01Q 21/0025* (2013.01); *H01Q 1/22* (2013.01); *H01Q 9/0407* (2013.01); *H01Q 13/08* (2013.01); *H01Q 21/065* (2013.01); *H01Q 23/00* (2013.01)

(58) Field of Classification Search
CPC ..... H01Q 21/065; H01Q 1/2208; H01Q 1/38; H01Q 1/52
See application file for complete search history.

(56) References Cited

U.S. PATENT DOCUMENTS 7,675,466 B2 * 3/2010 Gaucher ..... H01Q 21/0075 343/700 MS
2010/0109874 A1 5/2010 Yamagajo et al.
(Continued)

FOREIGN PATENT DOCUMENTS

JP 2013-229937 A 11/2013
JP 2014-531843 A 11/2014
(Continued)

OTHER PUBLICATIONS

International Search Report for International Application No. PCT/JP2018/012228 dated Jun. 12, 2018.
(Continued)

*Primary Examiner* — Hasan Islam
(74) *Attorney, Agent, or Firm* — Pearne & Gordon LLP

(57) ABSTRACT

An antenna module (10) includes a dielectric substrate (110), patch antennas (100) that are disposed at locations near a first main surface of the dielectric substrate (110), a RFIC (30) that is mounted at a location near a second main surface of the dielectric substrate (110) opposite the first main surface and that is electrically connected to the patch antennas (100), and an identification mark (50) that is located in an antenna arrangement area that is an area of the dielectric substrate (110) except for an outer circumferential area in which the patch antennas (100) are not arranged. The identification mark (50) is located in the antenna arrangement area so as not to overlap feed points (115) with which the respective patch antennas (100) are provided in a plan view of the first main surface.

17 Claims, 7 Drawing Sheets

(51) Int. Cl.

| | |
|---|---|
| ***H01Q 1/22*** | (2006.01) |
| ***H01Q 9/04*** | (2006.01) |
| ***H01Q 13/08*** | (2006.01) |
| ***H01Q 23/00*** | (2006.01) |

(56) References Cited

U.S. PATENT DOCUMENTS

| | | | | |
|---|---|---|---|---|
| 2014/0266897 | A1 | 9/2014 | Jakoby et al. | |
| 2016/0049723 | A1* | 2/2016 | Baks | H01Q 1/2291 343/848 |
| 2017/0229784 | A1 | 8/2017 | Kitamura et al. | |
| 2018/0205155 | A1* | 7/2018 | Mizunuma | H01Q 21/0025 |
| 2019/0319663 | A1* | 10/2019 | Shimura | H01Q 1/38 |

FOREIGN PATENT DOCUMENTS

| | | | |
|---|---|---|---|
| JP | 2016-131347 | A | 7/2016 |
| WO | 2009019738 | A1 | 2/2009 |
| WO | 2016/067906 | A1 | 5/2016 |
| WO | 2016/168432 | A1 | 10/2016 |

OTHER PUBLICATIONS

Written Opinion for International Application No. PCT/JP2018/012228 dated Jun. 12, 2018.

* cited by examiner

ANTENNA MODULE AND COMMUNICATION DEVICE

This is a continuation of International Application No. PCT/JP2018/012228 filed on Mar. 26, 2018 which claims priority from Japanese Patent Application No. 2017-076732 filed on Apr. 7, 2017. The contents of these applications are incorporated herein by reference in their entireties.

BACKGROUND OF THE DISCLOSURE

Field of the Disclosure

The present disclosure relates to an antenna module and a communication device.

Description of the Related Art

An array antenna device for wireless communication that includes patch antennas that are arranged in an array on a front surface of an antenna substrate is disclosed (see, for example, Patent Document 1). In this structure, an alignment mark that represents the location or direction of a component that is mounted is formed on a back surface of the antenna substrate.

Patent Document 1: International Publication No. 2016/067906

BRIEF SUMMARY OF THE DISCLOSURE

In some cases, an antenna module that includes an array antenna has identification marks such as a product identification number, a shipment inspection mark, and the alignment mark for recognizing the location or direction of a component that is mounted.

In the array antenna device disclosed in Patent Document 1, the alignment mark is formed on the back surface of the antenna substrate. After the array antenna device is mounted on, for example, a mother substrate, it is difficult to check the identification mark such as the alignment mark because the alignment mark is checked from the front of the front surface of the antenna substrate. Consequently, there is a problem in that the number of processes for checking the identification mark increases.

In some cases where the identification mark is formed at a location near the front surface of the antenna substrate, antenna characteristics are affected, although the number of processes for checking the identification mark decreases. In a method for forming the identification mark at the location near the front surface of the antenna substrate without affecting the antenna characteristics, an area in which the identification mark is to be formed is defined within an outer circumferential area around an area in which the patch antennas are formed. In this case, however, the size of the antenna module increases. In the case where the antenna module is used in a short wave length band such as a millimeter band, it is necessary to reduce a transmission loss in the antenna module and a transmission loss between the antenna module and an external circuit as much as possible. Also, from the perspective of the reduction in the transmission loss in the millimeter band, it is not preferable that a separated area in which the identification mark is to be formed is defined within the outer circumferential area around the area in which the patch antennas are formed and near the front surface of the antenna substrate, which leads to an increased size.

The present disclosure has been accomplished to solve the above problems, and it is an object of the present disclosure to provide a small antenna module and a communication device that inhibit the antenna characteristics from being degraded and that include an identification mark that can be readily sighted.

To achieve the above object, an antenna module according to an aspect of the present disclosure includes a dielectric substrate, patch antennas that are disposed at locations near a first main surface of the dielectric substrate, a radio frequency circuit component that is mounted at a location near a second main surface of the dielectric substrate opposite the first main surface and that is electrically connected to the patch antennas, and an identification mark that is located in an antenna arrangement area that is an area of the dielectric substrate near the first main surface of the dielectric substrate and except for an outer circumferential area in which the patch antennas are not arranged in a plan view of the first main surface. The identification mark is located in the antenna arrangement area so as not to overlap feed points with which the respective patch antennas are provided in a plan view of the first main surface.

This enables the identification mark to be sighted more easily than in the case where the identification mark is located at a location near a back surface of the dielectric substrate because the identification mark is located at a location near the front surface of the dielectric substrate, at which the patch antennas are formed. For this reason, lot information, for example, can be readily traced. The patch antennas and the radio frequency circuit component are arranged with the dielectric substrate interposed therebetween. The identification mark is not located near the feed points at which signal sensibility is high. There is no need for a separated area in which the identification mark is formed within the outer circumferential area around the antenna arrangement area. Accordingly, antenna characteristics of the antenna module are not degraded, and area reduction and size reduction can be achieved. In addition, radio frequency transmission lines between the patch antennas and the radio frequency circuit component can be shortened, and a transmission loss can be reduced particularly in a frequency band in which the transmission loss is large such as a millimeter band.

The identification mark may not overlap any of the patch antennas in the plan view.

This enables the antenna characteristics of the antenna module to be further inhibited from being degraded even when the identification mark is located in the antenna arrangement area.

The patch antennas may be arranged in a matrix. The patch antennas may include a first patch antenna and a second patch antenna that are adjacent to each other in a row direction in the plan view, and a third patch antenna and a fourth patch antenna that are adjacent to each other in the row direction. The first patch antenna and the third patch antenna may be adjacent to each other in a column direction intersecting with the row direction in the plan view. The second patch antenna and the fourth patch antenna may be adjacent to each other in the column direction in the plan view. The identification mark may be located between the first patch antenna and the fourth patch antenna and between the second patch antenna and the third patch antenna.

This enables the antenna characteristics of the antenna module to be further inhibited from being degraded, and the degree of freedom of the shape of the identification mark can be improved even when the identification mark is located in the antenna arrangement area.

The patch antennas may be arranged in a matrix. The patch antennas may include a first patch antenna and a second patch antenna that are adjacent to each other in a row direction in the plan view. The feed point of the first patch antenna may be unevenly distributed in a column direction intersecting with the row direction from a center of the first patch antenna in the plan view. The feed point of the second patch antenna may be unevenly distributed in the column direction from a center of the second patch antenna in the plan view. The identification mark may be located between the first patch antenna and the second patch antenna.

In this case, the direction of polarization of the antenna module coincides with the column direction, and an area between the first patch antenna and the second patch antenna does not overlap a polarization surface in the plan view and has low antenna sensibility. Consequently, the antenna characteristics of the antenna module can be effectively inhibited from being degraded even when the identification mark is located in the antenna arrangement area.

The patch antennas may be arranged in a matrix. The patch antennas may include a first patch antenna and a second patch antenna that are adjacent to each other in a row direction in the plan view. The feed point of the first patch antenna may be unevenly distributed in the row direction from a center of the first patch antenna in the plan view. The feed point of the second patch antenna may be unevenly distributed in the row direction from a center of the second patch antenna in the plan view. The identification mark may be located between the first patch antenna and the second patch antenna.

This enables the antenna characteristics of the antenna module to be further inhibited from being degraded even when the identification mark is located in the antenna arrangement area.

An area between the first patch antenna and the second patch antenna may include a first area nearer than the second patch antenna to the first patch antenna and a second area nearer than the first patch antenna to the second patch antenna. The identification mark may be located in the first area or the second area that is nearer than the other area to a center of gravity between the feed point of the first patch antenna and the feed point of the second patch antenna.

In this case, the identification mark is located in the area that is interposed between the first patch antenna and the second patch antenna in which the antenna sensibility decreases. Consequently, the antenna characteristics of the antenna module can be effectively inhibited from being degraded even when the identification mark is located in the antenna arrangement area.

The identification mark may be composed of a metal material.

The identification mark that is composed of a metal material has high conductivity, and electric field distribution that is formed by the patch antennas is likely to be affected when the identification mark is proximate to the patch antennas. However, the identification mark that is composed of a metal material can be formed by the same process as a process of forming the patch antennas, and the identification mark does not overlap the patch antennas. Consequently, a process of manufacturing the antenna module can be simplified, and the antenna characteristics can be inhibited from being degraded.

The patch antennas may include a first patch antenna and a second patch antenna that are adjacent to each other in a row direction in the plan view, and a third patch antenna and a fourth patch antenna that are adjacent to each other in the row direction. The first patch antenna and the third patch antenna may be adjacent to each other in a column direction intersecting with the row direction in the plan view. The second patch antenna and the fourth patch antenna may be adjacent to each other in the column direction in the plan view. The identification mark may be located so as to contain a center of gravity of a planar shape that connects the feed point of the first patch antenna, the feed point of the second patch antenna, the feed point of the third patch antenna, and the feed point of the fourth patch antenna to each other in the plan view.

This prevents the antenna characteristics of the antenna module from being degraded and enables area reduction and size reduction to be achieved even when the identification mark is so large that the identification mark overlaps the patch antennas because the identification mark is located so as to contain the center of gravity at which the antenna sensibility is low.

The identification mark may be composed of a dielectric material.

The identification mark that is composed of a dielectric material has low conductivity and is unlikely to affect the electric field distribution that is formed by the patch antennas even when the identification mark is proximate to the patch antennas. Consequently, the antenna characteristics can be inhibited from being degraded by using a dielectric material for the identification mark even when the identification mark is so large that the identification mark overlaps the patch antennas.

A shield wire may be disposed at a location near the first main surface between the patch antennas in the plan view and that extends in directions in which the patch antennas are arranged. The identification mark may not overlap the shield wire in the plan view.

In this case, the identification mark is not in contact with the shield wire even with the shield wire arranged between the patch antennas. Accordingly, isolation between the patch antennas is improved, the antenna characteristics of the antenna module are not degraded, and area reduction and size reduction can be achieved.

The patch antennas may include a first patch antenna and a second patch antenna that are adjacent to each other in a row direction in the plan view. The feed point of the first patch antenna may be unevenly distributed in the row direction with respect to a center of the first patch antenna. The feed point of the second patch antenna may be unevenly distributed in the row direction with respect to a center of the second patch antenna. The identification mark may be located between the first patch antenna and the second patch antenna and in an area between the first patch antenna and the shield wire or an area between the second patch antenna and the shield wire that is nearer than the other area to a center of gravity between the feed point of the first patch antenna and the feed point of the second patch antenna.

In this case, the identification mark is located in an area that is interposed between the first patch antenna and the second patch antenna in which the antenna sensibility decreases. Consequently, the antenna characteristics of the antenna module can be effectively inhibited from being degraded.

A communication device according to an aspect of the present disclosure includes the above antenna module and a BBIC (base band IC). The radio frequency circuit component is a RFIC that performs a signal process of a transmission system for outputting, to each patch antenna, a signal that is received from the BBIC and that is up-converted, or a signal process of a reception system for outputting, to the BBIC, a radio frequency signal that is received from each patch antenna and that is down-converted, or both.

The communication device that includes the above antenna module enables, for example, identification information to be readily traced after the antenna module is mounted, prevents the antenna characteristics from being degraded, and enables area reduction and size reduction to be achieved.

The present disclosure provides a small antenna module and a communication device that inhibit the antenna characteristics from being degraded and that have an identification mark that can be readily sighted.

DETAILED DESCRIPTION OF THE DISCLOSURE

Figure 1A:
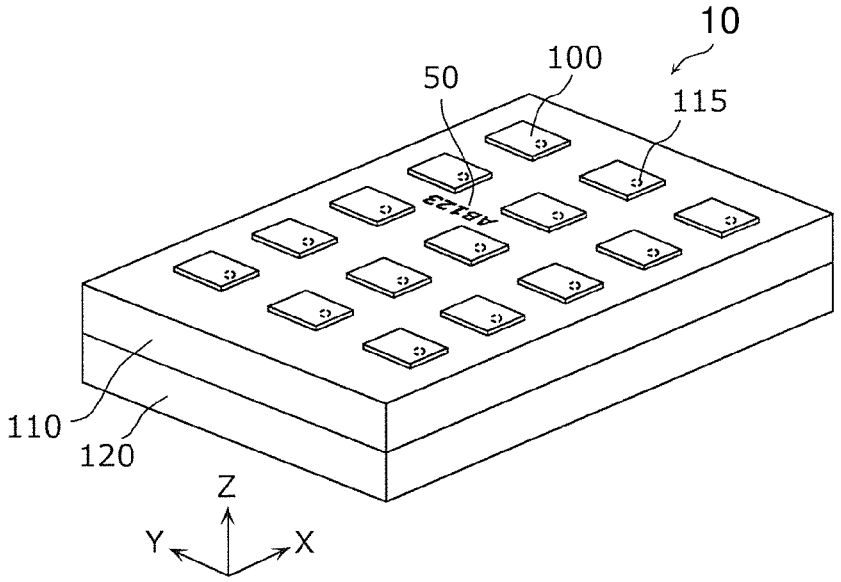
FIG. 1A is a perspective view of the appearance of an antenna module according to an embodiment.

An embodiment of the present disclosure will hereinafter be described in detail with reference to the drawings. The embodiment described below is a comprehensive or specific example. In the following embodiment, numerical values, shapes, materials, components, and the arrangement and connection form of the components, for example, are described by way of example and do not limit the present disclosure. Among the components according to the embodiment below, components that are not recited in the independent claims are described as optional components. The size of each component illustrated in the drawings or the ratio of the size is not necessarily illustrated strictly. In the drawings, substantially the same components are designated by like reference characters, and a duplicated description is omitted or simplified in some cases.

EMBODIMENT

[1 Antenna Module]

[1.1 Structure]

Figure 1B:
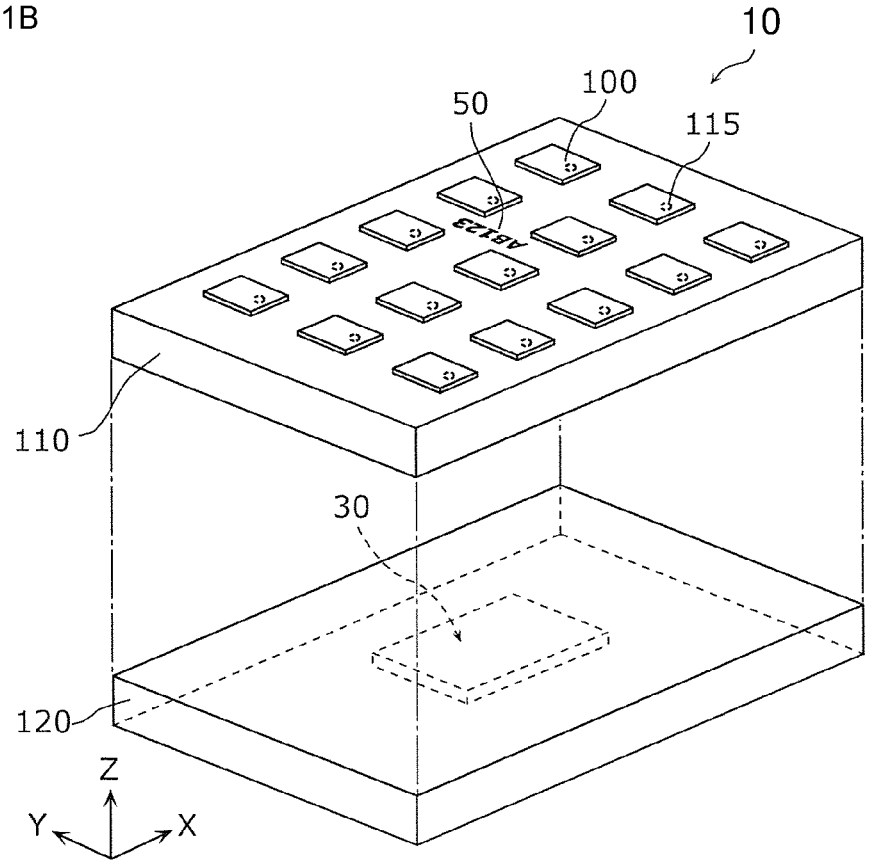
FIG. 1B is an exploded perspective view of the antenna module according to the embodiment.
Figure 2A:
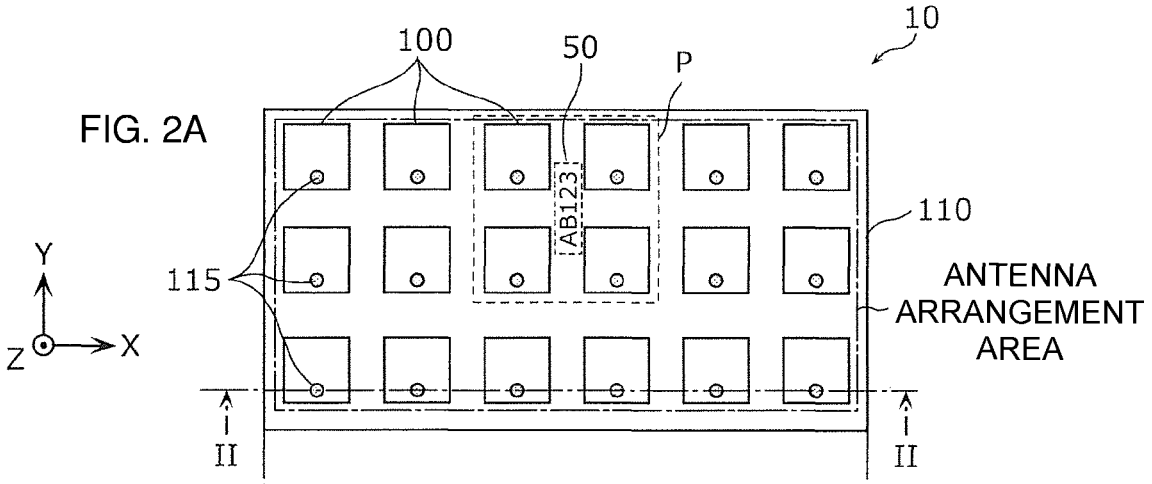
FIGS. 2A and 2B illustrate a plan view and a sectional view of the antenna module according to the embodiment, respectively.
Figure 2B:
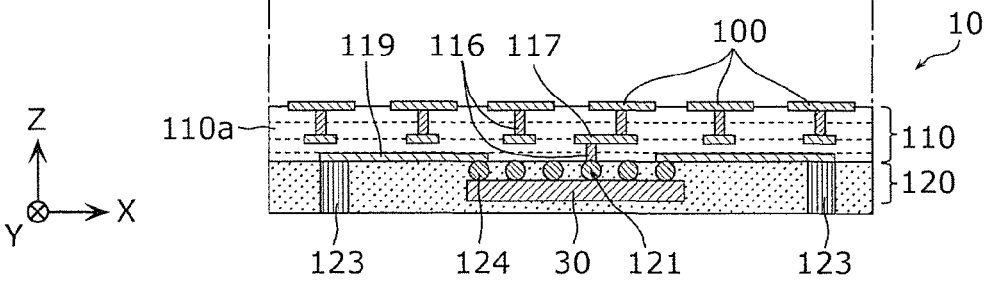

FIG. 1A, FIG. 1B, FIG. 2A, and FIG. 2B illustrate the structure of an antenna module 10 according to an embodiment. Specifically, FIG. 1A is a perspective view of the appearance of the antenna module 10 according to the embodiment, and FIG. 1B is an exploded perspective view of the antenna module 10 according to the embodiment. FIG. 1B illustrates a state in which a dielectric substrate 110 and a sealing member 120 are isolated from each other. FIGS. 2A and 2B illustrate a plan view and a sectional view of the antenna module 10 according to the embodiment, respectively. More specifically, FIG. 2A illustrates the plan view in which the dielectric substrate 110 is seen through, and the antenna module 10 is viewed from the front of an upper surface (from a plus location on a Z-axis in the figure), and FIG. 2B illustrates the sectional view taken along line II-II in FIG. 2A.

In the following description, the thickness direction of the antenna module 10 is referred to as a Z-axis direction, orthogonal directions that are perpendicular to the Z-axis direction are referred to as an X-axis direction and a Y-axis direction, and the plus location on the Z-axis means a location near the upper surface of the antenna module 10. In practical application, however, the thickness direction of the antenna module 10 does not coincide with the vertical direction in some cases. Accordingly, the location near the upper surface of the antenna module 10 is not limited by the upward direction. According to the present embodiment, the antenna module 10 has a substantially rectangular, flat plate shape, and the X-axis direction and the Y-axis direction are parallel to two side surfaces of the antenna module 10 that are adjacent to each other. The shape of the antenna module 10 is not limited thereto and may be, for example, a substantially circular, flat plate shape. Furthermore, the shape is not limited to a flat plate shape and may be a shape in which a central portion has a thickness that differs from that of an edge portion.

A surface electrode (also referred to as a land or a pad), which is a terminal of a RFIC 30, or a conductive joining material (for example, solder) that is connected to the surface electrode is exposed from the upper surface of the sealing member 120. In FIG. 1B, however, an illustration thereof is omitted. In FIG. 2B, for simplicity, some components that are technically located on different sections are illustrated in the same figure, or an illustration of some components that are located on the same section is omitted.

As illustrated in FIG. 1A, the antenna module 10 includes the dielectric substrate 110, patch antennas 100, the RFIC 30, and an identification mark 50. According to the present embodiment, the sealing member 120 is disposed on the lower surface of the dielectric substrate 110. Components that are included in the antenna module 10 will be specifically described.

As illustrated in FIG. 2B, the dielectric substrate 110 includes a substrate body 110*a* composed of a dielectric material and various conductors for forming, for example, the above patch antennas 100. According to the present embodiment, as illustrated in FIG. 1B and in FIG. 2A, the dielectric substrate 110 is a multilayer substrate that has a substantially rectangular, flat plate shape and that includes stacked dielectric layers. The dielectric substrate 110, however, is not limited thereto, may have, for example, a substantially circular, flat plate shape, and may be a single-layer substrate.

The patch antennas 100 are arranged at locations near an upper surface (plus locations on the Z-axis), which is near a first main surface of the dielectric substrate 110, and radiate or receive radio frequency signals. According to the present embodiment, eighteen patch antennas 100 that are arranged in two dimensions of 6×3 form an array antenna.

The number and arrangement of the patch antennas 100 that form the array antenna are not limited thereto. For example, the patch antennas 100 may be arranged in a single dimension. The patch antennas 100 may not be arranged linearly in a row direction or a column direction and may be arranged in, for example, a staggered form.

As illustrated in FIGS. 2A and 2B, each patch antenna 100 includes a pattern conductor that is disposed on the main surface of the dielectric substrate 110 substantially parallel thereto and includes a feed point 115 on the lower surface of the pattern conductor. The patch antenna 100 radiates a radio frequency signal that is fed into a space or receives a radio frequency signal in the space. According to the present embodiment, the patch antenna 100 radiates a radio frequency signal that is fed from the RFIC 30 to the feed point 115 into the space or receives a radio frequency signal in the space to output the radio frequency signal from the feed point 115 to the RFIC 30. That is, the patch antenna 100 according to the present embodiment also serves as a radiating element that radiates a radio wave (a radio frequency signal propagating through a space) corresponding to the radio frequency signal that is transmitted between the patch antenna 100 and the RFIC 30 and as a receiving element that receives the radio wave.

According to the present embodiment, each patch antenna 100 has a rectangular shape surrounded by a pair of sides that extend in the Y-axis direction and that are opposite to each other in the X-axis direction and a pair of sides that extend in the X-axis direction and that are opposite to each other in the Y-axis direction in a plan view of the antenna module 10 (when viewed from a plus location on the Z-axis), and the feed point 115 is located so as to shift from the center of the rectangular shape in a minus direction along a Y-axis. For this reason, the direction of polarization of the radio wave that is radiated or received by the patch antenna 100 according to the present embodiment coincides with the Y-axis direction. It is not necessary for each feed point 115 to be located at the same location in the corresponding patch antenna 100. For example, the feed points 115 of some of the patch antennas 100 may be located so as to shift from the center in a plus direction along the Y-axis. In the case where the polarization does not have a single orientation but has plural orientations, the feed points 115 of some of the patch antennas 100 may be located so as to sit from the center in a direction along an X-axis.

The wave length and band width ratio of the radio wave, for example, depend on the size (the size in the Y-axis direction and the size in the X-axis direction, here) of each patch antenna 100. For this reason, the size of the patch antenna 100 can be appropriately determined depending on a required specification such as a frequency.

In FIG. 1A, FIG. 1B, FIG. 2A, and FIG. 2B, for simplicity, the patch antennas 100 illustrated are exposed from the upper surface of the dielectric substrate 110. However, it is only necessary for the patch antennas 100 to be disposed at locations near the upper surface of the dielectric substrate 110. For example, when the dielectric substrate 110 is a multilayer substrate, the patch antennas 100 may be disposed in an inner layer of the multilayer substrate.

The location "near the upper surface" means a location above the center in the vertical direction. That is, regarding the dielectric substrate 110 that has the first main surface and a second main surface opposite thereto, "to be disposed at a location near the first main surface" means to be disposed at a location nearer than the second main surface to the first main surface. In the following description, the same is true for the expression of the other components.

As illustrated in FIG. 1B, FIG. 2A and FIG. 2B, the antenna module 10 also includes signal conductor supports 123, which are signal terminals, at locations near the lower surface of the dielectric substrate 110. According to the present embodiment, the RFIC 30 and the signal conductor supports 123 are covered by the sealing member 120 except for the lower surface of the signal conductor supports 123. The number of the signal conductor supports 123 is not particularly limited provided that the number is one or more. The signal conductor supports 123 may not be provided. That is, the dielectric substrate 110 with the patch antennas 100 formed may be directly mounted on a mother substrate (mounting substrate).

In addition to pattern conductors for forming the patch antennas 100, the various conductors of the dielectric substrate 110 include a conductor for forming a circuit that is included in the antenna module 10 together with the array antenna and the RFIC 30. Specifically, the conductors include via conductors 116 and a pattern conductor 117 included in feed lines for transmitting radio frequency signals between ANT terminals 121 of the RFIC 30 and the feed points 115 of the patch antennas 100, and pattern conductors 119 for transmitting signals between the signal conductor supports 123 and I/O terminals 124 of the RFIC 30.

The pattern conductor 117 is disposed in an inner layer of the dielectric substrate 110 along the main surface of the dielectric substrate 110 and connects, for example, the via conductor 116 that is connected to the feed point 115 of the patch antenna 100 and the via conductor 116 that is connected to the ANT terminal 121 of the RFIC 30 to each other.

Each via conductor 116 is an interlayer connection conductor that extends in the thickness direction perpendicular to the main surface of the dielectric substrate 110 and that connects, for example, pattern conductors that are disposed in different layers to each other.

The pattern conductors 119 are disposed on the lower surface of the dielectric substrate 110 along the main surface of the dielectric substrate 110 and connect, for example, the signal conductor supports 123 and the I/O terminals 124 of the RFIC 30 to each other.

Examples of the dielectric substrate 110 include a low temperature co-fired ceramic (LTCC) substrate or a printed circuit board.

In the dielectric substrate 110, a pair of ground pattern conductors that are opposite to each other with the pattern conductor 117 interposed therebetween may be disposed in layers above and below the pattern conductor 117. The ground pattern conductors may be disposed over the entire length of the dielectric substrate 110. The pattern conductors 119 may be disposed in an inner layer of the dielectric substrate 110 and may connect the signal conductor supports 123 and the I/O terminals 124 of the RFIC 30 to each other with via conductors interposed therebetween.

The sealing member 120 is disposed at a location near the lower surface (second main surface) of the dielectric substrate 110 and composed of a resin that seals the RFIC 30. According to the present embodiment, the RFIC 30 and the signal conductor supports 123 are embedded in the sealing member 120. The material of the sealing member 120 is not particularly limited, and examples thereof include an epoxy resin or a polyimide resin.

The sealing member 120 may not be in direct contact with the lower surface of the dielectric substrate 110, and an insulating film, for example, may be disposed between the sealing member 120 and the lower surface.

The RFIC 30 is a radio frequency circuit component that is mounted at a location near the lower surface of the dielectric substrate 110 and that is electrically connected to the patch antennas 100, and forms a RF-signal-processing circuit. The RFIC 30 performs the signal process of the transmission system for outputting, to each patch antenna 100, a signal that is received from a BBIC 40 described later via the corresponding signal conductor support 123 and that is up-converted, or the signal process of the reception system for outputting, to the BBIC 40, a radio frequency signal that is received from the patch antenna 100 and that is down-converted via the signal conductor support 123, or both.

According to the present embodiment, the RFIC 30 includes the ANT terminals 121 associated with the corresponding patch antennas 100 and the I/O terminals 124 associated with the corresponding signal conductor supports 123. For example, the RFIC 30 performs the signal process of the transmission system for, for example, up-converting and demultiplexing a signal that is inputted into the I/O terminal 124 (that functions as an input terminal here) in the transmission system via the signal conductor support 123 in the transmission system to feed signals from the ANT terminals 121 to the patch antennas 100. For example, the RFIC 30 performs the signal process of the reception system for, for example, multiplexing and down-converting signals that are received by the patch antennas 100 and that are inputted into the ANT terminals 121 to output a signal from the I/O terminal 124 (that functions as an output terminal) in the reception system via the signal conductor support 123 in the reception system.

An example of signal processing of the RFIC 30 will be described later together with the structure of a communication device that uses the antenna module 10.

As illustrated in FIGS. 2A and 2B, the RFIC 30 is preferably disposed in an area obtained by projecting, in the Z-axis direction, an antenna arrangement area, which is an upper surface area of the dielectric substrate 110 in which the patch antennas 100 are arranged, when viewed in the direction perpendicular to the upper surface of the dielectric substrate 110 (that is, from a plus location on the Z-axis). In this manner, the feed lines that connect the RFIC 30 and the patch antennas 100 to each other can be designed to be short.

The antenna arrangement area is the minimum area that contains the patch antennas 100 when viewed in the above direction and is a rectangular area according to the present embodiment. In other words, the antenna arrangement area is an area near the upper surface of the dielectric substrate 110 and except for an outer circumferential area in which the patch antennas 100 are not arranged. The shape of the antenna arrangement area corresponds to the form of arrangement of the patch antennas 100 and is not limited to a rectangular shape.

Each signal conductor support 123 is disposed at a location near the lower surface of the dielectric substrate 110, is a signal terminal that is electrically connected to the RFIC 30, and is a conductor support that extends through the sealing member 120 in the thickness direction. The upper surface of the signal conductor support 123 is connected to the corresponding pattern conductor 119 of the dielectric substrate 110, and the lower surface thereof is exposed from the lower surface of the sealing member 120. The signal conductor support 123 becomes an outer connection terminal of the antenna module 10 when the antenna module 10 is mounted on the mother substrate (not illustrated). That is, the antenna module 10 is mounted on the mother substrate in a manner in which the signal conductor support 123 is electrically and mechanically connected to an electrode of the mother substrate by, for example, reflow. The material of the signal conductor support 123 is not particularly limited, and an example thereof is a copper having a low resistance value.

Each signal conductor support 123 may not be disposed on the lower surface of the dielectric substrate 110. That is, an upper end portion of the signal conductor support 123 may be embedded in the dielectric substrate 110 and may not be in direct contact with the lower surface of the dielectric substrate 110, and an insulating film, for example, may be disposed between the signal conductor support 123 and the lower surface.

In the antenna module 10 according to the present embodiment, the patch antennas 100 are disposed at locations near the first main surface (near the upper surface according to the present embodiment) of the dielectric substrate 110, and the radio frequency circuit component (the RFIC 30 according to the present embodiment) is mounted at a location near the second main surface (near the lower surface according to the present embodiment) of the dielectric substrate 110, as described above.

According to the present embodiment, in this manner, the feed lines that connect the radio frequency circuit component and the patch antennas 100 to each other can be designed to be short. This enables a loss due to the feed lines to be reduced, and achieves high performance of the antenna module 10. The antenna module 10 is suitable for a millimeter-band antenna module that is likely to increase the loss due to the feed lines as the length of the feed lines increases.

The antenna module 10 according to the present embodiment includes the identification mark 50. The identification mark 50 is any one of a symbol, a character, a numeral, a figure, and a combination thereof, and examples thereof include a lot number that represents the product identification number of the antenna module 10, a shipment inspection mark, and an alignment mark for recognizing the location and direction of a component that is mounted. That is, the identification mark 50 is a mark for identifying the antenna module 10 while the antenna module 10 is being manufactured and after the antenna module 10 is manufactured.

The identification mark 50 is composed of, for example, a metal material or a dielectric material. In case where the identification mark 50 is composed of a metal material, the identification mark 50 can be formed at the same time as the patch antennas 100 are formed during a process of forming the patch antennas 100 because the patch antennas 100 are composed of a metal material. For this reason, a process of manufacturing the antenna module 10 can be simplified. In the case where the identification mark 50 is composed of a dielectric material, the identification mark 50 is formed by a process that differs from the process of forming the patch antennas 100. The identification mark 50 that is composed of a dielectric material has low conductivity, and is unlikely to affect the electric field distribution that is formed by the patch antennas 100 even when the identification mark 50 is proximate to the patch antennas 100. From the perspective that antenna characteristics of the patch antennas 100 are unlikely to be affected, the dielectric constant of a dielectric material of which the identification mark 50 is composed is preferably decreased.

According to the present embodiment, the identification mark 50 is located in the antenna arrangement area and does not overlap the feed points 115 with which the respective patch antennas 100 are provided in a plan view of the dielectric substrate 110 from the front of the upper surface of the antenna module (when viewed from a plus location on the Z-axis). The antenna arrangement area is the minimum area that contains the patch antennas 100 in a plan view of the dielectric substrate 110 as described above. In other words, the antenna arrangement area is the area of the upper surface of the dielectric substrate 110 except for the outer circumferential area in which the patch antennas 100 are not arranged.

This enables the identification mark 50 to be sighted without any damages after mounting because the identification mark 50 is located in the antenna arrangement area that is exposed to an outer space even after the antenna module 10 is mounted on, for example, the mother substrate. Consequently, identification information such as lot information can be readily traced. The patch antennas 100 and the RFIC 30 are arranged with the dielectric substrate 110 interposed therebetween. The identification mark 50 is not located near the feed points 115 at which signal sensibility is high. There is no need for a separated area in which the identification mark 50 is formed other than the antenna arrangement area. Accordingly, the antenna characteristics of the antenna module 10 are not degraded, and area reduction and size reduction can be achieved. In addition, radio frequency transmission lines between the patch antennas 100 and the RFIC 30 can be shortened, and a transmission loss can be reduced particularly in a frequency band in which the transmission loss is large such as the millimeter band.

[1.2 Relationship Between Location of Identification Mark and Antenna Characteristics]

The relationship between the location of the identification mark 50 and the antenna characteristics will now be described. What will be first described is a result of simulation of an effect of the identification mark 50 on the antenna characteristics.

Figures 3A, 3B, 3C:
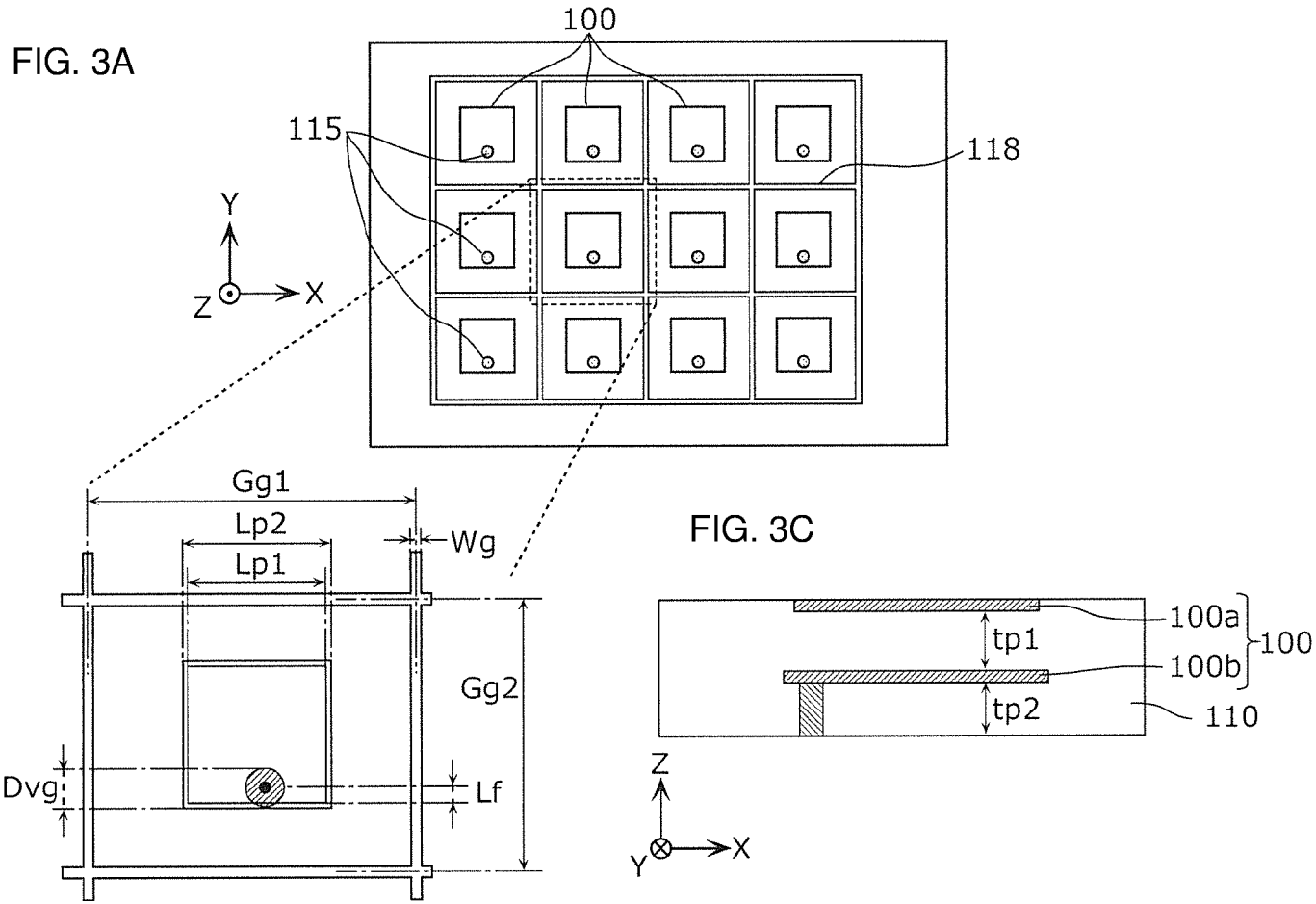
FIGS. 3A, 3B and 3C illustrate a plan view and sectional views of a simulation model, respectively.
Figure 4:
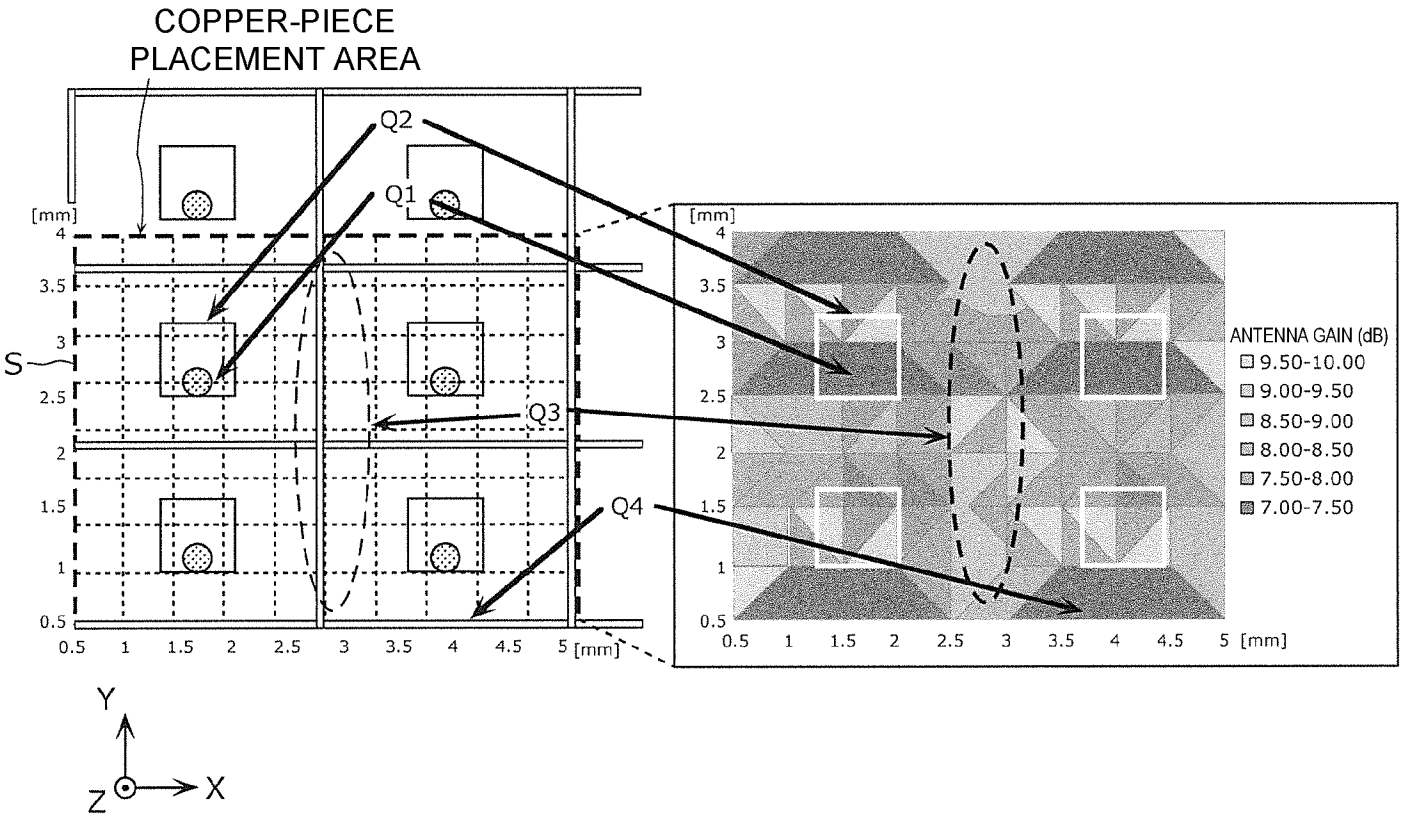
FIG. 4 illustrates the distribution of the antenna gain obtained by a simulation.

FIGS. 3A, 3B and 3C illustrate a plan view and sectional views of a simulation model, respectively. FIG. 4 illustrates the distribution of the antenna gain obtained by the simulation.

The simulation model of an array antenna as illustrated in FIGS. 3A, 3B and 3C is set to evaluate the effect of the identification mark 50 on the antenna characteristics. Table 1 illustrates parameters of the simulation model.

TABLE 1

| Entire Area | 4 × 3 Array<br>9.92 mm × 5.615 mm |
|---|---|
| Width Lp1 of Parasitic Element 100a | 0.70 mm |
| Width Lp2 of Driven Element 100b | 0.76 mm |
| Location Lf of Feed Point 115 | 0.108 mm |
| Diameter Dvg of GND Conductor Removal (for Feed Via Passage) | 0.3 mm |
| Width Wg of Shield Wire 118 | 0.08 mm |
| Gap Gg1 of Shield Wire 118 in X-axis Direction | 2.46 mm |
| Gap Gg2 of Shield Wire 118 in Y-axis Direction | 1.845 mm |
| Thickness tp1 of Dielectric Substrate 110 (driven element - Upper Surface) | 0.22 mm |
| Thickness tp2 of Dielectric Substrate 110 (driven element - Lower Surface) | 0.14 mm |

Each patch antenna 100 of the antenna module 10 according to the embodiment illustrated in FIG. 1A and FIG. 1B is described by way of example as being composed of the single pattern conductor that has the feed point 115. In the present simulation model, however, as illustrated in FIG. 3C, each patch antenna 100 includes a driven element 100*b*, which is a pattern conductor that has the feed point 115, and a parasitic element 100*a* that does not have the feed point 115, that faces the upper surface of the driven element 100*b*, and that is away from the driven element 100*b*. As illustrated in FIG. 3A, a shield wire 118 is arranged in a lattice pattern between the patch antennas 100 that are adjacent to each other.

Variation in the antenna gain is calculated in the case where a metal piece (copper piece of 0.5 mm square×0.01 mm thickness) is placed at a location near the upper surface (at a plus location on the Z-axis) of an antenna of the simulation model illustrated in FIGS. 3A, 3B and 3C and Table 1. The metal piece affects the antenna gain (magnetic field distribution) more than the other material pieces. Accordingly, the metal piece is a suitable material for evaluating the effect of a foreign substance on the patch antennas that are arranged in a matrix.

The above metal piece is moved 0.5 mm in the X-axis direction or in the Y-axis direction within an area S on the left-hand side in FIG. 4. At this time, only four patch antennas within the area S are switched on. FIG. 4 illustrates, on the right-hand side, a result of distributions of the antenna gain that are obtained with the metal piece arranged at different coordinates (X, Y) and that are overlapped. The following knowledge is obtained from the result in FIG. 4.

(1) In the case where the metal piece is not arranged, substantial antenna gain is 9.37 dBi.

(2) The antenna gain is decreased by 1.8 dB or less near the feed point (Q1 in FIG. 4).

(3) The antenna gain is decreased by 0.8 dB or less near a location opposite the feed point (Q2 in FIG. 4).

(4) The antenna gain is decreased by 0.1 dB or less at a location (Q3 in FIG. 4) between the patch antennas that are adjacent to each other in the X-axis direction.

(5) The antenna gain is decreased by 2 dB or more at a location on an edge (Q4 in FIG. 4) of a dielectric substrate that is proximate to the feed point.

The decrease in the antenna gain due to the location of the identification mark 50 is preferably 0.1 dB or less. It is revealed from this that the optimum location of the identification mark 50 is (4) the location (Q3 in FIG. 4) between the patch antennas that are adjacent to each other in the X-axis direction.

The following description includes the location of the identification mark 50 that is led from the result of the above simulation in each antenna module 10 according to a first example to a sixth example.

[1.3 Location of Identification Mark According to First Example]

Figure 5A:
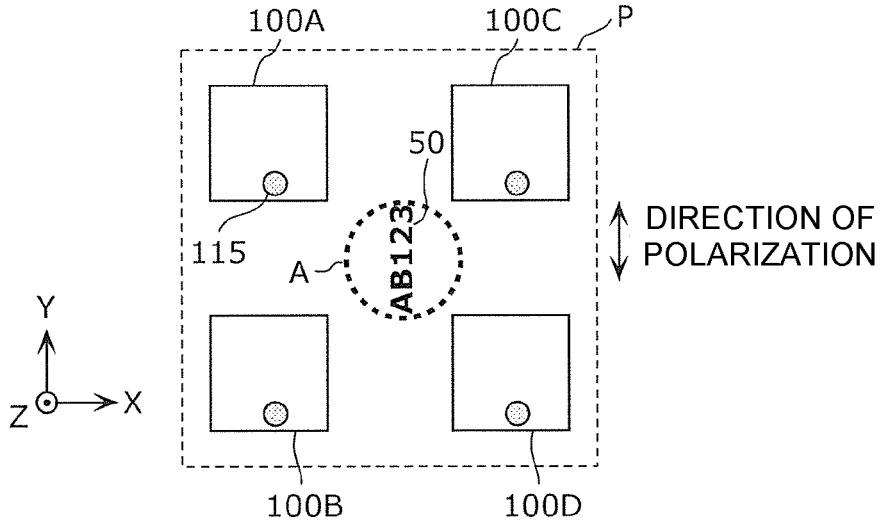
FIG. 5A illustrates the location of an identification mark of an antenna module according to a first example.

FIG. 5A illustrates the location of the identification mark 50 of the antenna module 10 according to the first example. FIG. 5A illustrates a modification to the location of the identification mark 50 in an enlargement area P illustrated in FIGS. 2A and 2B.

As illustrated in FIG. 5A, there are patch antennas 100A, 100B, 100C, and 100D in the enlargement area P. The patch antennas 100A and 100B correspond to a first patch antenna and a second patch antenna that are adjacent to each other in the Y-axis direction (the row direction). The patch antennas 100C and 100D correspond to a third patch antenna and a fourth patch antenna that are adjacent to each other in the Y-axis direction (the row direction). The patch antennas 100A and 100C are adjacent to each other in the X-axis direction (the column direction intersecting with the row direction). The patch antennas 100B and 100D are adjacent to each other in the X-axis direction (the column direction).

As illustrated in FIG. 5A, the identification mark 50 ("AB123" in FIG. 5A) does not overlap any of the patch antennas 100 (100A to 100D) in a plan view of the antenna module 10 (when viewed from a plus location on the Z-axis).

The identification mark 50 is located between the patch antenna 100A and the patch antenna 100D and between the patch antenna 100B and the patch antenna 100C (in an area A in FIG. 5A). That is, the identification mark 50 does not overlap the four patch antennas 100A to 100D that are arranged in a matrix and is located in an area that is surrounded by the four patch antennas 100A to 100D in the plan view.

With the above structure, the identification mark can be sighted with no damage after mounting because the identification mark 50 is located in the antenna arrangement area even after the antenna module 10 is mounted. Consequently, the lot information, for example, can be readily traced. The patch antennas 100 and the RFIC 30 are arranged with the dielectric substrate 110 interposed therebetween. The identification mark 50 is not located near the feed points 115 at which the signal sensibility is high. There is no need for a separated area in which the identification mark 50 is formed other than the antenna arrangement area. Accordingly, the antenna characteristics of the antenna module 10 are not degraded, and area reduction and size reduction can be achieved. In addition, the radio frequency transmission lines between the patch antennas 100 and the RFIC 30 can be shortened, and the transmission loss can be reduced particularly in a frequency band in which the transmission loss is large such as the millimeter band.

In the area A in which the identification mark 50 is located, the antenna gain is decreased less than in an area that is interposed between two patch antennas, and the antenna characteristics of the antenna module 10 can be further inhibited from being degraded. In addition, the above area A can be larger than the area that is interposed between the two patch antennas in the X-axis direction and the Y-axis direction, and the degree of freedom of the shape of the identification mark 50 is improved.

In the case where the identification mark 50 is composed of a metal material, there is a possibility that the electric field distribution that is formed by the patch antennas 100 is likely to be affected when the identification mark 50 is proximate to the patch antennas 100 because the identification mark 50 has high conductivity, and that the antenna gain is further decreased. According to the first example, however, the identification mark 50 does not overlap any of the patch antennas 100 in the plan view. Accordingly, the identification mark 50 according to the present example may be composed of a metal material. This enables the identification mark 50 to be formed by the same process as the process of forming the patch antennas 100 that are composed of a metal material. Consequently, the process of manufacturing the antenna module 10 can be simplified, and the antenna characteristics can be inhibited from being degraded.

[1.4 Location of Identification Mark According to Second Example]

Figure 5B:
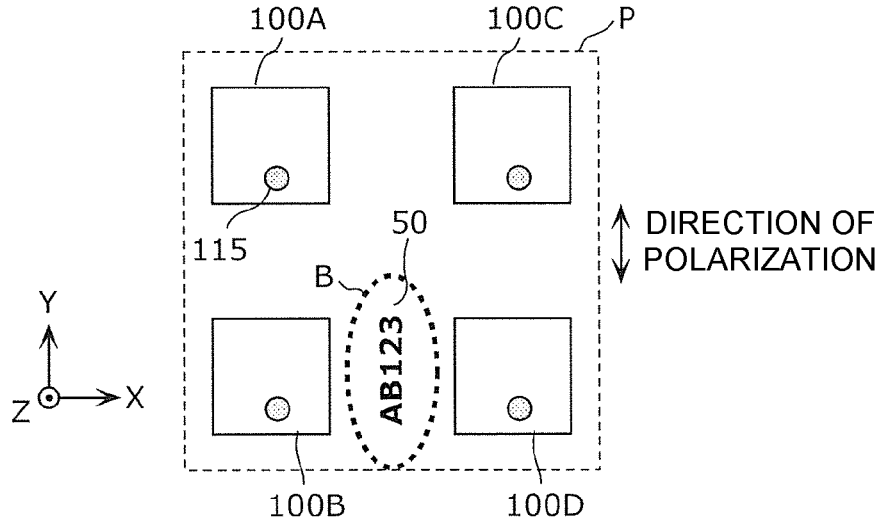
FIG. 5B illustrates the location of an identification mark of an antenna module according to a second example.

FIG. 5B illustrates the location of the identification mark 50 of the antenna module 10 according to the second example. FIG. 5B illustrates a modification to the location of the identification mark 50 in the enlargement area P illustrated in FIGS. 2A and 2B. The antenna module 10 illustrated in FIG. 5B differs from the antenna module 10 according to the first example illustrated in FIG. 5A in the location of the identification mark 50 only. Different subject matters between the antenna module 10 according to the second example and the antenna module 10 according to the first example will be mainly described, and a description of the same subject matters as in the antenna module 10 according to the first example is omitted.

As illustrated in FIG. 5B, there are the patch antennas 100A, 100B, 100C, and 100D in the enlargement area P. The patch antennas 100B and 100D correspond to the first patch antenna and the second patch antenna that are adjacent to each other in the X-axis direction (the column direction). The feed point 115 of each of the patch antennas 100A, 100B, 100C, and 100D is unevenly distributed in the minus direction along the Y-axis (the row direction intersecting with the column direction) from the center of the patch antenna 100 in a plan view of the antenna module 10 (when viewed from a plus location on the Z-axis).

As illustrated in FIG. 5B, the identification mark 50 ("AB123" in FIG. 5B) does not overlap any of the patch antennas 100 (100A to 100D) in the plan view.

The identification mark 50 is located between the patch antenna 100B and the patch antenna 100D (in an area B in FIG. 5B). That is, the identification mark 50 is located in an area that does not intersect with a polarization surface of the patch antennas 100B and a polarization surface of the patch antenna 100D in the plan view.

With the above structure, the direction of polarization of the antenna module 10 coincides with the Y-axis direction (the row direction), the above area B does not overlap the polarization surfaces of the patch antennas 100A to 100D in the plan view and has low antenna sensibility, and the decrease in the antenna gain is small. Consequently, the antenna characteristics of the antenna module 10 can be effectively inhibited from being degraded even when the identification mark 50 is located in the area B.

The identification mark 50 according to the second example does not overlap any of the patch antennas 100 in the plan view. Accordingly, the identification mark 50 according to the present example may be composed of a metal material. This enables the identification mark 50 to be formed by the same process as the process of forming the patch antennas 100 that are composed of a metal material. Consequently, the process of manufacturing the antenna module 10 can be simplified, and the antenna characteristics can be inhibited from being degraded.

[1.5 Location of Identification Mark According to Third Example]

Figure 5C:
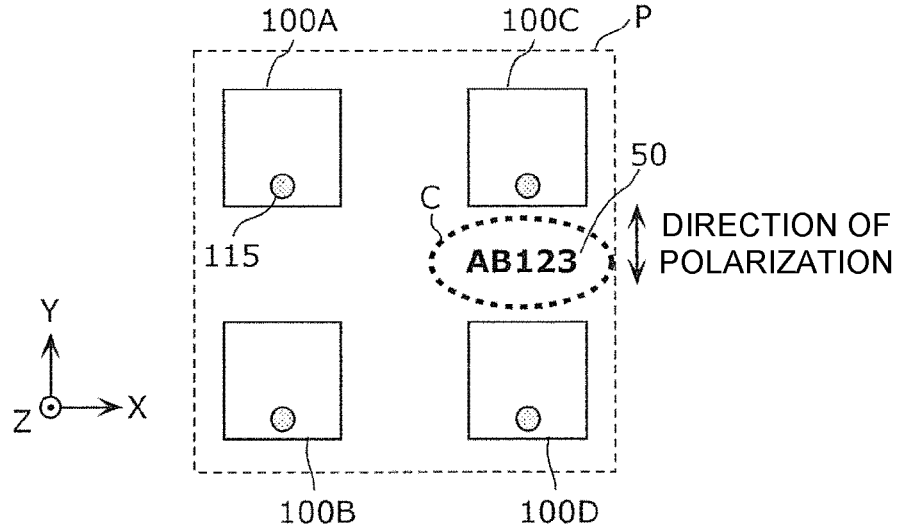
FIG. 5C illustrates the location of an identification mark of an antenna module according to a third example.

FIG. 5C illustrates the location of the identification mark 50 of the antenna module 10 according to the third example. FIG. 5C illustrates a modification to the location of the identification mark 50 in the enlargement area P illustrated in FIGS. 2A and 2B. The antenna module 10 illustrated in FIG. 5C differs from the antenna module 10 according to the first example illustrated in FIG. 5A in the location of the identification mark 50 only. Different subject matters between the antenna module 10 according to the third example and the antenna module 10 according to the first example will be mainly described, and a description of the same subject matters as in the antenna module 10 according to the first example is omitted.

As illustrated in FIG. 5C, there are the patch antennas 100A, 100B, 100C, and 100D in the enlargement area P. The patch antennas 100C and 100D correspond to the first patch antenna and the second patch antenna that are adjacent to each other in the Y-axis direction (the row direction). The feed point 115 of each of the patch antennas 100A, 100B, 100C, and 100D is unevenly distributed in the minus direction along the Y-axis (the row direction) from the center of the patch antenna 100 in a plan view of the antenna module 10 (when viewed from a plus location on the Z-axis).

As illustrated in FIG. 5C, the identification mark 50 ("AB123" in FIG. 5C) does not overlap any of the patch antennas 100 (100A to 100D) in the plan view.

The identification mark 50 is located between the patch antenna 100C and the patch antenna 100D (in an area C in FIG. 5C). That is, the identification mark 50 is located in an area intersecting with the polarization surface of the patch antenna 100C and the polarization surface of the patch antenna 100D in the plan view.

With the above structure, the direction of polarization of the antenna module 10 coincides with the Y-axis direction (the row direction), and the above area C intersects with the polarization surfaces of the patch antennas 100A to 100D in the plan view. However, the antenna sensibility thereof is lower than those in the patch antennas 100, and the decrease in the antenna gain is small. Consequently, the antenna characteristics of the antenna module 10 can be inhibited from being degraded even when the identification mark 50 is located in the area C.

The identification mark 50 according to the third example does not overlap any of the patch antennas 100 in the plan view. Accordingly, the identification mark 50 according to the present example may be composed of a metal material. This enables the identification mark 50 to be formed by the same process as the process of forming the patch antennas 100 that are composed of a metal material. Consequently, the process of manufacturing the antenna module 10 can be simplified, and the antenna characteristics can be inhibited from being degraded.

[1.6 Location of Identification Mark According to Fourth Example]

Figure 5D:
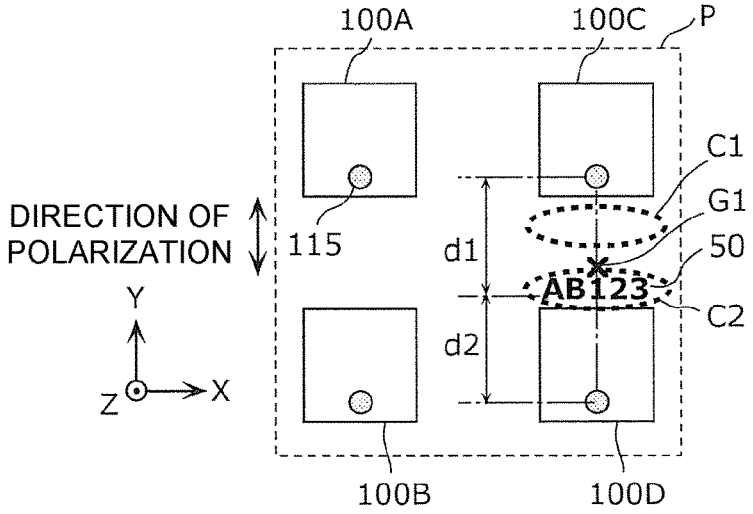
FIG. 5D illustrates the location of an identification mark of an antenna module according to a fourth example.

FIG. 5D illustrates the location of the identification mark 50 of the antenna module 10 according to the fourth example. FIG. 5D illustrates a modification to the location of the identification mark 50 in the enlargement area P illustrated in FIGS. 2A and 2B. The antenna module 10 illustrated in FIG. 5D differs from the antenna module 10 according to the first example illustrated in FIG. 5A in the location of the identification mark 50 only. Different subject matters between the antenna module 10 according to the fourth example and the antenna module 10 according to the first example will be mainly described, and a description of the same subject matters as in the antenna module 10 according to the first example is omitted.

As illustrated in FIG. 5D, there are the patch antennas 100A, 100B, 100C, and 100D in the enlargement area P. The patch antennas 100C and 100D correspond to the first patch antenna and the second patch antenna that are adjacent to each other in the Y-axis direction (the row direction). The feed point 115 of each of the patch antennas 100A, 100B, 100C, and 100D is unevenly distributed in the minus direction along the Y-axis (the row direction) from center of the patch antenna 100 in a plan view of the antenna module 10 (when viewed from a plus location on the Z-axis).

As illustrated in FIG. 5D, the identification mark 50 ("AB123" in FIG. 5D) does not overlap any of the patch antennas 100 (100A to 100D) in the plan view.

As illustrated in FIG. 5D, an area between the patch antenna 100C and the patch antenna 100D contains an area C1 (first area) nearer than the patch antenna 100D to the patch antenna 100C and an area C2 (second area) nearer than the patch antenna 100C to the patch antenna 100D.

In the above structure, the identification mark 50 is located in the area C2 that is nearer than the area C1 to the center of gravity G1 between the feed point 115 of the patch antenna 100D and the feed point 115 of the patch antenna 100C. In other words, the identification mark 50 is located in the area C2 that is farther than the area C1 to the feed points 115 of the patch antennas 100.

With the above structure, the identification mark 50 is located in the area that is interposed between the patch antenna 100C and the patch antenna 100D in which the antenna sensibility decreases. Consequently, the antenna characteristics of the antenna module can be effectively inhibited from being degraded even when the identification mark 50 is located in the area C2.

The identification mark 50 according to the fourth example does not overlap any of the patch antennas 100 in the plan view. Accordingly, the identification mark 50 according to the present example may be composed of a metal material. This enables the identification mark 50 to be formed by the same process as the process of forming the patch antennas 100 that are composed of a metal material. Consequently, the process of manufacturing the antenna module 10 can be simplified, and the antenna characteristics can be inhibited from being degraded.

[1.7 Location of Identification Mark According to Fifth Example]

Figure 6:
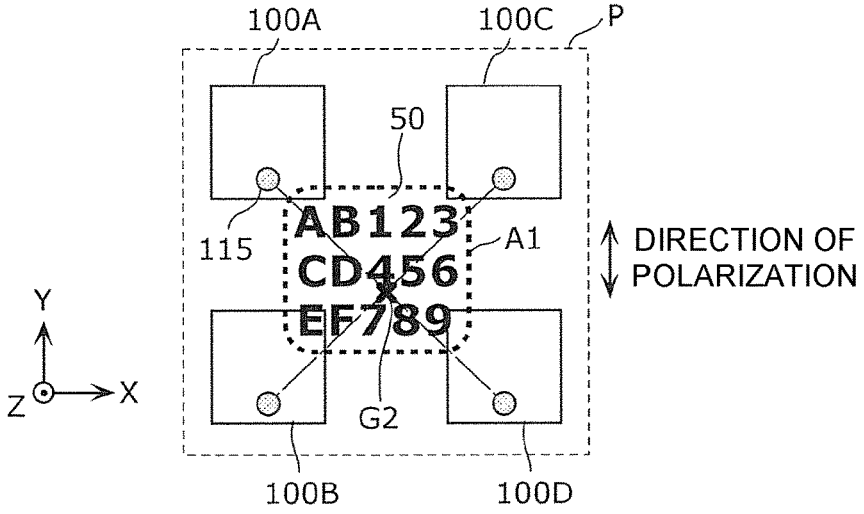
FIG. 6 illustrates the location of an identification mark of an antenna module according to a fifth example.

FIG. 6 illustrates the location of the identification mark 50 of the antenna module 10 according to the fifth example. FIG. 6 illustrates a modification to the location of the identification mark 50 in the enlargement area P illustrated in FIGS. 2A and 2B. The antenna module 10 illustrated in FIG. 6 differs from the antenna module 10 according to the first example illustrated in FIG. 5A in the location of the identification mark 50 only. Different subject matters between the antenna module 10 according to the fifth example and the antenna module 10 according to the first example will be mainly described, and a description of the same subject matters as in the antenna module 10 according to the first example is omitted.

As illustrated in FIG. 6, there are the patch antennas 100A, 100B, 100C, and 100D in the enlargement area P. The patch antennas 100A and 100B correspond to the first patch antenna and the second patch antenna that are adjacent to each other in the Y-axis direction (the row direction). The patch antennas 100C and 100D correspond to the third patch antenna and the fourth patch antenna that are adjacent to each other in the Y-axis direction (the row direction). The patch antennas 100A and 100C are adjacent to each other in the X-axis direction (the column direction intersecting with the row direction). The patch antennas 100B and 100D are adjacent to each other in the X-axis direction (the column direction).

As illustrated in FIG. 6, the identification mark 50 ("AB123CD456EF789" in FIG. 6) overlaps at least one of the patch antennas 100A to 100D in a plan view of the antenna module 10 (when viewed from a plus location on the Z-axis).

The identification mark 50 is located so as to contain the center of gravity G2 between the feed point 115 of the patch antenna 100A, the feed point 115 of the patch antenna 100B, the feed point 115 of the patch antenna 100C, and the feed point 115 of the patch antenna 100D. In other words, the identification mark 50 is located such that the distance to the feed point 115 of each patch antenna 100 is the maximum distance.

This prevents the antenna characteristics of the antenna module 10 from being degraded and enables area reduction and size reduction to be achieved even when the identification mark 50 is so large that the identification mark 50 overlaps the patch antennas 100 because the identification mark 50 is located so as to contain the center of gravity G2 at which the antenna sensibility is low.

The identification mark 50 according to the fifth example may be composed of a dielectric material. The identification mark that is composed of a dielectric material has low conductivity and is unlikely to affect the electric field distribution that is formed by the patch antennas 100 even when the identification mark 50 is proximate to the patch antennas 100. Consequently, the antenna characteristics can be inhibited from being degraded by using a dielectric material for the identification mark 50 even when the identification mark is so large that the identification mark overlaps the patch antennas 100 as in the identification mark 50 according to the present example. From the perspective that the antenna characteristics of the patch antennas 100 are unlikely to be affected, the dielectric constant of a dielectric material of which the identification mark 50 is composed is preferably decreased.

[1.8 Location of Identification Mark According to Sixth Example]

Figure 7:
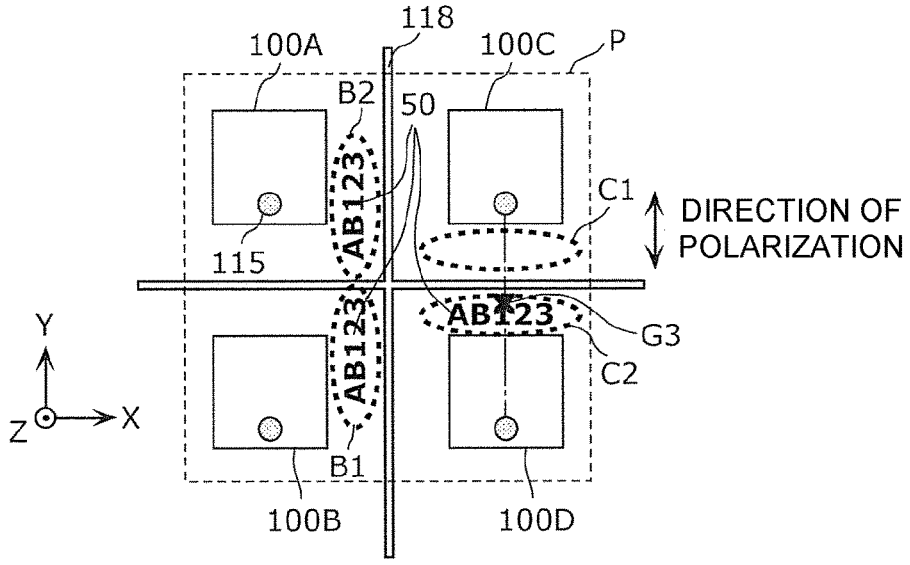
FIG. 7 illustrates the location of an identification mark of an antenna module according to a sixth example.

FIG. 7 illustrates the location of the identification mark 50 of the antenna module 10 according to the sixth example. FIG. 7 illustrates a modification to the location of the identification mark 50 in the enlargement area P illustrated in FIGS. 2A and 2B. The antenna module 10 illustrated in FIG. 7 differs from the antenna module 10 according to the first example illustrated in FIG. 5A in the location of the identification mark 50 and the structure of the upper surface of the dielectric substrate 110. Different subject matters between the antenna module 10 according to the sixth example and the antenna module 10 according to the first example will be mainly described, and a description of the same subject matters as in the antenna module 10 according to the first example is omitted.

As illustrated in FIG. 7, there are the patch antennas 100A, 100B, 100C, and 100D in the enlargement area P. The patch antennas 100A and 100B correspond to the first patch antenna and the second patch antenna that are adjacent to each other in the Y-axis direction (the row direction). The patch antennas 100C and 100D correspond to the third patch antenna and the fourth patch antenna that are adjacent to each other in the Y-axis direction (the row direction). The patch antennas 100A and 100C are adjacent to each other in the X-axis direction (the column direction intersecting with the row direction). The patch antennas 100B and 100D are adjacent to each other in the X-axis direction (the column direction).

The antenna module 10 further includes the shield wire 118 that is disposed at a location near the upper surface (at a plus location on the Z-axis), which is near the first main surface of the dielectric substrate 110. The shield wire 118 is arranged in a lattice pattern between the patch antennas 100 and extends in the directions in which the patch antennas 100 are arranged in a plan view of the antenna module 10 (when viewed from a plus location on the Z-axis). The shield wire 118 particularly improves the isolation between the patch antennas 100 that are adjacent to each other.

As illustrated in FIG. 7, the identification mark 50 ("AB123" at at least one of three locations illustrated in FIG. 7) is located in the antenna arrangement area so as not to overlap the feed points 115 with which the respective patch antennas 100 are provided in the plan view. The antenna arrangement area is the minimum area that contains the patch antennas 100 in a plan view of the dielectric substrate 110 as described above. In other words, the antenna arrangement area is the area of the upper surface of the dielectric substrate 110 except for the outer circumferential area in which the patch antennas 100 are not arranged.

In addition, the identification mark 50 does not overlap the shield wire 118 in the plan view.

With the above structure, since the identification mark 50 does not overlap the shield wire 118, the isolation between the patch antennas 100 is improved, the antenna characteristics of the antenna module 10 are not degraded, and area reduction and size reduction can be achieved.

As illustrated in FIG. 7, the identification mark 50 according to the present example may be located, for example, in any one of areas B1, B2, and C2 that do not overlap the shield wire 118 and that are located between two patch antennas 100.

According to the present example, the feed point 115 of each of the patch antennas 100A to 100D is unevenly distributed in the minus direction along the Y-axis with respect to the center of the patch antenna.

In this case, the identification mark 50 may be located, for example, in the area C2 between the patch antenna 100C and the patch antenna 100D, among the area C1 and the area C2. The area C1 is located between the patch antenna 100C and the shield wire 118. The area C2 is located between the patch antenna 100D and the shield wire 118. This is due to the fact that the area C2 is nearer than the area C1 to the center of gravity G3 between the feed point 115 of the patch antenna 100D and the feed point 115 of the patch antenna 100C.

In this case, the identification mark 50 is located in the area C2 in which the antenna sensibility decreases within the area that is interposed between the patch antenna 100C and the patch antenna 100D that are adjacent to each other. Consequently, the antenna characteristics of the antenna module 10 can be effectively inhibited from being degraded even when the identification mark 50 is located in the area C2.

[2 Communication Device]

The antenna module 10 according to the present embodiment is mounted on the mother substrate such as the printed circuit board with the lower surface being a mounting surface, and can be included in a communication device, for example, together with the BBIC 40 that is mounted on the mother substrate.

Regarding this, the antenna module 10 according to the present embodiment achieves high directivity by controlling the phase and signal intensity of the radio frequency signal that is radiated from each patch antenna 100. The antenna module 10 can be used for a communication device that supports, for example, massive MIMO (Multiple Input Multiple Output), which is one of promising wireless transmission technologies of 5G (the fifth generation mobile communication system).

In view of this, such a communication device and the process of the RFIC 30 of the antenna module 10 will now be described.

Figure 8:
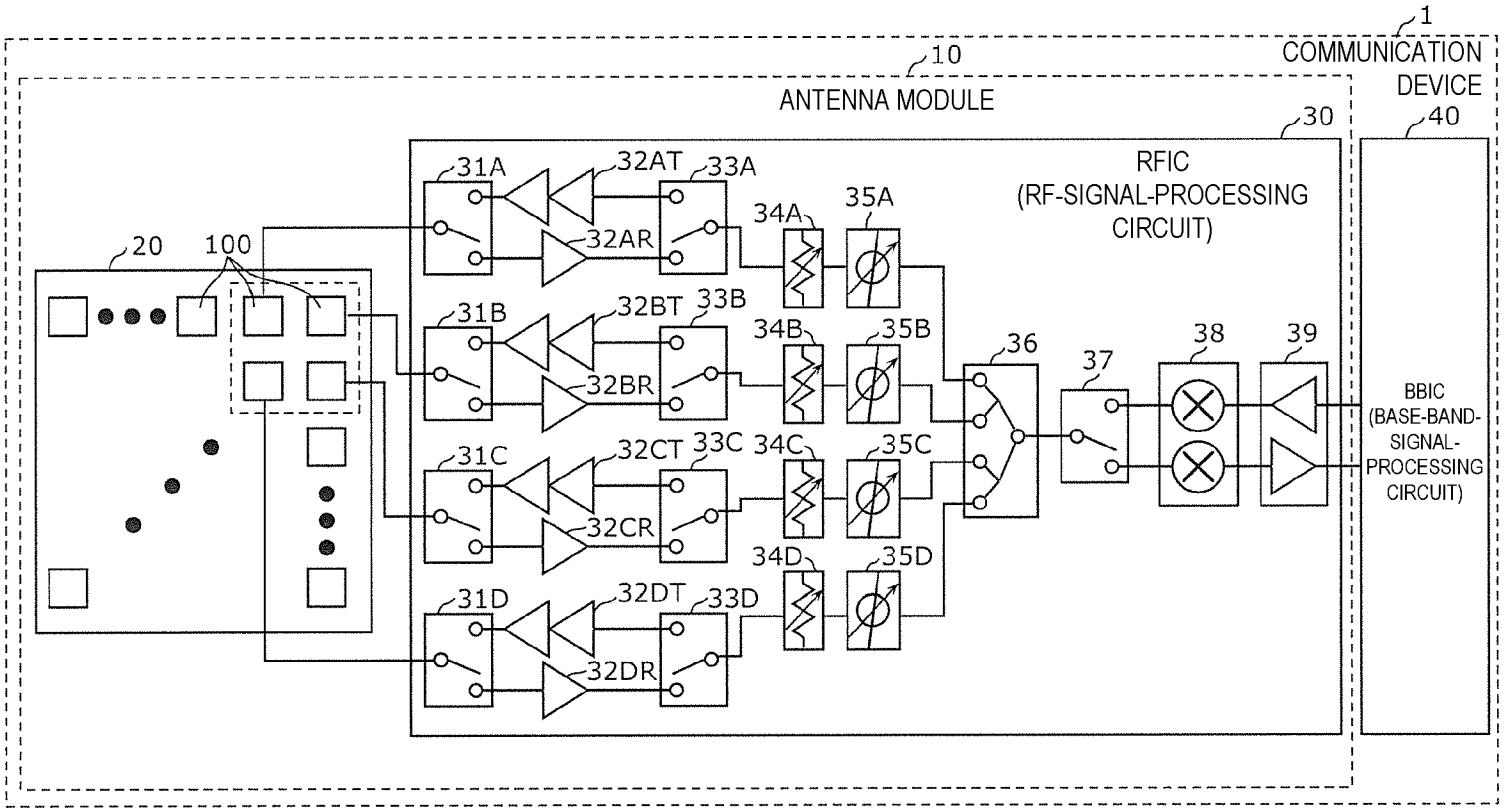
FIG. 8 is a block diagram illustrating a communication device that includes the antenna module according to the embodiment.

FIG. 8 is a block diagram illustrating a communication device 1 that includes the antenna module 10 according to the embodiment. In FIG. 8, for simplicity, only circuit blocks associated with four patch antennas 100 of the patch antennas 100 of an array antenna 20 among circuit blocks of the RFIC 30 are illustrated, and an illustration of the other circuit blocks is omitted. The circuit blocks associated with the four patch antennas 100 will be described below, and a description of the other circuit blocks is omitted.

As illustrated in FIG. 8, the communication device 1 includes the antenna module 10 and the BBIC 40 that is included in a base-band-signal-processing circuit.

The antenna module 10 includes the array antenna 20 and the RFIC 30 as described above.

The RFIC 30 includes switches 31A to 31D, 33A to 33D, and 37, power amplifiers 32AT to 32DT, low-noise amplifiers 32AR to 32DR, attenuators 34A to 34D, phase shifters 35A to 35D, a signal combiner/demultiplexer 36, a mixer 38, and an amplifier circuit 39.

The switches 31A to 31D and 33A to 33D are switch circuits for switching between transmission and reception through signal paths.

A signal that is transmitted from the BBIC 40 to the RFIC 30 is amplified by the amplifier circuit 39 and up-converted by the mixer 38. A radio frequency signal that is up-converted is demultiplexed by the signal combiner/demultiplexer 36 into four signals, which pass through four transmission paths and are fed to the different patch antennas 100. At this time, the directivity of the array antenna 20 can be adjusted by separately adjusting phase shifts of the phase shifters 35A to 35D that are arranged on the signal paths.

The radio frequency signals that are received by the patch antennas 100 of the array antenna 20 pass through four different reception paths, are multiplexed by the signal combiner/demultiplexer 36, down-converted by the mixer 38, amplified by the amplifier circuit 39, and transmitted to the BBIC 40.

The RFIC 30 may not include any one of the switches 31A to 31D, 33A to 33D, and 37, the power amplifiers 32AT to 32DT, the low-noise amplifiers 32AR to 32DR, the attenuators 34A to 34D, the phase shifters 35A to 35D, the signal combiner/demultiplexer 36, the mixer 38, and the amplifier circuit 39 described above. The RFIC 30 may include only the transmission paths or the reception paths. The communication device 1 according to the present embodiment can be used for a system that transmits and receives not only a radio frequency signal in a single frequency band (a band) but also radio frequency signals in frequency bands (multi-band).

The RFIC 30 thus includes the power amplifiers 32AT to 32DT that amplify the radio frequency signals. The patch antennas 100 radiate the signals that are amplified by the power amplifiers 32AT to 32DT.

Since the communication device 1 with the above structure includes the antenna module 10 according to the present embodiment, the identification mark 50 can be sighted with no damage even after the antenna module 10 is mounted on the mother substrate because the identification mark 50 is located in the antenna arrangement area after the mounting. Consequently, the lot information, for example, can be readily traced. The patch antennas 100 and the RFIC 30 are arranged with the dielectric substrate 110 interposed therebetween. The identification mark 50 is not located near the feed points 115 at which the signal sensibility is high. There is no need for a separated area in which the identification mark 50 is formed other than the antenna arrangement area. Accordingly, the antenna characteristics of the antenna module 10 are not degraded, and area reduction and size reduction of the communication device 1 can be achieved. In addition, the radio frequency transmission lines between the patch antennas 100 and the RFIC 30 can be shortened, and the transmission loss can be reduced particularly in a frequency band in which the transmission loss is large such as the millimeter band.

(Other Modifications)

The antenna modules according to the embodiment of the present disclosure and the examples thereof and the communication device are described above. The present disclosure, however, is not limited to the above embodiment and the examples thereof. The present disclosure includes another embodiment that is achieved by a combination of freely selected components according to the above embodiment, a modification that is obtained by modifying the above embodiment in various ways that can be conceived by a person skilled in the art without departing from the spirit of the present disclosure, and various devices that include the antenna modules and the communication device according to the present disclosure.

For example, in the above description, the RFIC 30 performs both of the signal process of the transmission system and the signal process of the reception system, but is not limited thereto. The RFIC 30 may perform only one of the processes.

In the above description, the RFIC 30 is taken as an example of the radio frequency circuit component. The radio frequency circuit component, however, is not limited thereto. For example, the radio frequency circuit component is a power amplifier that amplifies a radio frequency signal, and each patch antenna 100 may radiate a signal that is amplified by the power amplifier. Alternatively, for example, the radio frequency circuit component may be a phase-adjusting circuit that adjusts the phase of a radio frequency signal that is transmitted between each patch antenna 100 and the radio frequency circuit component.

In the above description, the antenna module 10 includes the sealing member 120. The antenna module 10, however, may not include the sealing member 120. Signal terminals such as the signal conductor supports 123 and a ground terminal may be surface electrodes, which are pattern electrodes that are disposed at locations near the second main surface (for example, on the second main surface) of the dielectric substrate 110. The antenna module 10 with such a structure can be mounted on, for example, a mother substrate that has a cavity structure by using the signal terminals and the ground terminal.

According to the above embodiment, the patch antennas are described as antenna elements by way of example. However, the antenna elements that are included in the antenna module may not be the patch antennas, but may be, for example, rigid antennas or dipole antennas.

The present disclosure can be widely applied to antenna elements that have a band pass filter function for communication devices such as millimeter band mobile communication systems and massive MIMO systems.

1 communication device
10 antenna module
20 array antenna
30 RFIC
31A, 31B, 31C, 31D, 33A, 33B, 33C, 33D, 37 switch
32AR, 32BR, 32CR, 32DR low-noise amplifier
32AT, 32BT, 32CT, 32DT power amplifier
34A, 34B, 34C, 34D attenuator
35A, 35B, 35C, 35D phase shifter
36 signal combiner/demultiplexer
38 mixer
39 amplifier circuit
40 BBIC
50 identification mark
100, 100A, 100B, 100C, 100D patch antenna
100*a* parasitic element
100*b* driven element
110 dielectric substrate
110*a* substrate body
115 feed point
116 via conductor
117, 119 pattern conductor

118 shield wire
120 sealing member
121 ANT terminal
123 signal conductor support
124 I/O terminal

The invention claimed is:

1. An antenna module comprising:

a dielectric substrate;

patch antennas disposed at locations near a first main surface of the dielectric substrate;

a radio frequency circuit component mounted at a location near a second main surface of the dielectric substrate opposite the first main surface and electrically connected to the patch antennas; and an identification mark located in an antenna arrangement area, wherein the antenna arrangement area is an area of the dielectric substrate near the first main surface of the dielectric substrate except for an outer circumferential area in which the patch antennas are not arranged when viewed in a plan view of the first main surface, wherein the identification mark is located in the antenna arrangement area so as not to overlap feed points provided in respective ones of the patch antennas when viewed in a plan view of the first main surface, wherein the patch antennas include a first patch antenna, a second patch antenna, a third patch antenna and a fourth patch antenna, wherein the first patch antenna and the second patch antenna are adjacent to each other in a row direction in the plan view, wherein the third patch antenna and the fourth patch antenna are adjacent to each other in the row direction, wherein the first patch antenna and the third patch antenna are adjacent to each other in a column direction intersecting with the row direction in the plan view, wherein the second patch antenna and the fourth patch antenna are adjacent to each other in the column direction in the plan view, and wherein the identification mark is located so as to contain a center of gravity of a planar shape connecting the feed point of the first patch antenna, the feed point of the second patch antenna, the feed point of the third patch antenna, and the feed point of the fourth patch antenna to each other in the plan view.

2. The antenna module according to claim 1, wherein the identification mark does not overlap any of the patch antennas in the plan view.

3. The antenna module according to claim 2, wherein the identification mark is composed of a metal material.

4. The antenna module according to claim 1, wherein the identification mark is composed of a dielectric material.

5. The antenna module according to claim 1, further comprising:

a shield wire disposed at a location near the first main surface between the patch antennas in the plan view and extending in directions in which the patch antennas are arranged, and wherein the identification mark does not overlap the shield wire in the plan view.

6. A communication device comprising:

the antenna module according to claim 1; and a base band integrated circuit, wherein the radio frequency circuit component is a radio frequency integrated circuit configured to perform a signal process of a transmission system for outputting, to each patch antenna, a signal received from the base band integrated circuit and up-converted, or a signal process of a reception system for outputting, to the base band integrated circuit, a radio frequency signal received from each patch antenna and down-converted, or both.

7. The antenna module according to claim 2, further comprising:

a shield wire disposed at a location near the first main surface between the patch antennas in the plan view and extending in directions in which the patch antennas are arranged, and wherein the identification mark does not overlap the shield wire in the plan view.

8. An antenna module comprising:

a dielectric substrate;

patch antennas disposed at locations near a first main surface of the dielectric substrate;

a radio frequency circuit component mounted at a location near a second main surface of the dielectric substrate opposite the first main surface and electrically connected to the patch antennas; and an identification mark located in an antenna arrangement area, wherein the antenna arrangement area is an area of the dielectric substrate near the first main surface of the dielectric substrate except for an outer circumferential area in which the patch antennas are not arranged when viewed in a plan view of the first main surface, wherein the identification mark is located in the antenna arrangement area so as not to overlap feed points provided in respective ones of the patch antennas when viewed in a plan view of the first main surface, wherein the identification mark does not overlap any of the patch antennas in the plan view, wherein the patch antennas are arranged in a matrix, wherein the patch antennas include a first patch antenna and a second patch antenna, and the first patch antenna and the second patch antenna are adjacent to each other in a row direction in the plan view, wherein the feed point of the first patch antenna is unevenly distributed in a column direction intersecting with the row direction from a center of the first patch antenna in the plan view, and wherein the feed point of the second patch antenna is unevenly distributed in the column direction from a center of the second patch antenna in the plan view, and wherein the identification mark is located between the first patch antenna and the second patch antenna.

9. The antenna module according to claim 8, wherein the identification mark is composed of a metal material.

10. The antenna module according to claim 8, further comprising:

a shield wire disposed at a location near the first main surface between the patch antennas in the plan view and extending in directions in which the patch antennas are arranged, and wherein the identification mark does not overlap the shield wire in the plan view.

11. A communication device comprising:

the antenna module according to claim 8; and a base band integrated circuit, wherein the radio frequency circuit component is a radio frequency integrated circuit configured to perform a signal process of a transmission system for outputting, to each patch antenna, a signal received from the base band integrated circuit and up-converted, or a signal process of a reception system for outputting, to the base band integrated circuit, a radio frequency signal received from each patch antenna and down-converted, or both.

12. An antenna module comprising:

a dielectric substrate;

patch antennas disposed at locations near a first main surface of the dielectric substrate;

a radio frequency circuit component mounted at a location near a second main surface of the dielectric substrate opposite the first main surface and electrically connected to the patch antennas; and an identification mark located in an antenna arrangement area, wherein the antenna arrangement area is an area of the dielectric substrate near the first main surface of the dielectric substrate except for an outer circumferential area in which the patch antennas are not arranged when viewed in a plan view of the first main surface, wherein the identification mark is located in the antenna arrangement area so as not to overlap feed points provided in respective ones of the patch antennas when viewed in a plan view of the first main surface, wherein the identification mark does not overlap any of the patch antennas in the plan view, wherein the patch antennas are arranged in a matrix, wherein the patch antennas include a first patch antenna and a second patch antenna, and the first patch antenna and the second patch antenna are adjacent to each other in a row direction in the plan view, wherein the feed point of the first patch antenna is unevenly distributed in the row direction from a center of the first patch antenna in the plan view, and wherein the feed point of the second patch antenna is unevenly distributed in the row direction from a center of the second patch antenna in the plan view, and wherein the identification mark is located between the first patch antenna and the second patch antenna.

13. The antenna module according to claim 12, wherein an area between the first patch antenna and the second patch antenna includes a first area nearer to the first patch antenna than to the second patch antenna, and a second area nearer to the second patch antenna than to the first patch antenna, and wherein the identification mark is located in one of the first area and the second area nearer to a center of gravity between the feed point of the first patch antenna and the feed point of the second patch antenna.

14. The antenna module according to claim 12, wherein the identification mark is composed of a metal material.

15. The antenna module according to claim 13, wherein the identification mark is composed of a metal material.

16. The antenna module according to claim 12, further comprising:

a shield wire disposed at a location near the first main surface between the patch antennas in the plan view and extending in directions in which the patch antennas are arranged, and wherein the identification mark does not overlap the shield wire in the plan view.

17. A communication device comprising:

the antenna module according to claim 12; and a base band integrated circuit, wherein the radio frequency circuit component is a radio frequency integrated circuit configured to perform a signal process of a transmission system for outputting, to each patch antenna, a signal received from the base band integrated circuit and up-converted, or a signal process of a reception system for outputting, to the base band integrated circuit, a radio frequency signal received from each patch antenna and down-converted, or both.

* * * * *